United States Patent [19]

Oida

[11] Patent Number: 4,594,863

[45] Date of Patent: Jun. 17, 1986

[54] WASHING MACHINE

[75] Inventor: Susumu Oida, Aichi, Japan

[73] Assignee: Tokyo Shibaura Denki Kabushiki Kaisha, Japan

[21] Appl. No.: 557,970

[22] Filed: Dec. 5, 1983

[30] Foreign Application Priority Data

Dec. 29, 1982 [JP] Japan ..... 57-232594

[51] Int. Cl.[4] ..... D06F 13/02; D06F 17/10

[52] U.S. Cl. ..... 68/133; 68/134

[58] Field of Search ..... 68/133, 23.7, 134, 136, 68/138; 366/276, 278

[56] References Cited

U.S. PATENT DOCUMENTS

| | | | |
|---|---|---|---|
| 1,805,107 | 5/1931 | Rocke | 68/134 |
| 1,861,640 | 6/1932 | McCabe | 366/278 X |
| 2,091,402 | 8/1937 | Waterworth | 366/276 X |
| 2,192,758 | 3/1940 | Skinner | 68/133 X |
| 2,255,505 | 9/1941 | Dunham | 68/133 X |
| 2,416,611 | 2/1947 | Castricone | 68/134 X |
| 2,674,868 | 4/1954 | Williams | 68/23.7 |
| 2,770,122 | 11/1956 | Jackson | 68/133 |

FOREIGN PATENT DOCUMENTS

| | | | |
|---|---|---|---|
| 70250 | 3/1902 | France | 68/134 |

*Primary Examiner*—Philip R. Coe
*Assistant Examiner*—Frankie L. Stinson
*Attorney, Agent, or Firm*—Cushman, Darby & Cushman

[57] ABSTRACT

A washing machine having an improved pulsator which includes a skirt, vanes projecting from the skirt, and a shaped projection having a planar surface located eccentrically from the center of rotation of the skirt and extended to a position higher than the vanes. The pulsator rotates in the forward and reverse directions to responsively effect eccentric motion of the projection about the central axis of rotation so that highly turbulent localized water flow is established in conjunction with a vortex flow arrangement to enhance the washing capabilities of the machine.

7 Claims, 4 Drawing Figures

WASHING MACHINE

BACKGROUND OF THE INVENTION

Conventional washing machines generally accomplish washing action by establishing a vortex flow within a washing tub to repeatedly draw articles being washed in the tub of the machine from the upper region thereof to the lower region along the agitator and then return them once again to the upper region along the walls of the tub. In such a manner, the articles being washed will contact not only one another but also the agitator and walls of the tub to produce the desired rubbing action necessary to completely clean them. Thus, the articles being washed are subjected to agitation and movement through the tub so as to accomplish the desired washing function.

However, such conventional washing machines oftentimes fail to completely achive their intended purpose of establishing a sufficient vortex flow within the tub so as to induce circulated movement of the articles therein. Furthermore, as the weight of the washed articles increases, hydraulic foces induced by conventional agitators may be insufficient to produce the intended circulation leading to undesirable stratification of the articles in the tub and the stagnation of the washing liquid therein. Accordingly, many conventional washing machines do not always wash articles to the degree that is expected by consumers.

There have, of course, been attempts in the art for enhancing the agitation capabilities of washing machines so as to provide positive flow of the articles being washed through the wash liquid. One such proposal is shown in U.S. Pat. No. 4,207,760 to Bochan. The rotatable agitator of the Bochan patent utilizes vane blade pairs disposed along the base and inclined with respect to one another so as to form a V-shaped trough. Radial vanes are provided, each associated with a respective V-shaped trough, so as to "pull" fabric articles in the upper region of the rub towards the center of the agitator.

The V-shaped troughs of Bochan effect mechanical engagement of the fabric articles to slide them radially outwardly at the base of the agitator and this effect is enhanced by the vanes pulling the clothes in at the upper region of the tube and guiding them down into the V-shaped trough. However, such an effect does not depend upon the fluid conditions in the tub owing to the mechanical engagement of the V-shaped troughs and vanes with the fabric articles. Accordingly, whereas the agitator of Bochan may enhance the washing capabilities of the machine, an undesirable degree of abrasion may be experienced by the fabric articles owing to the mechanical engagment of the V-shaped troughs and vanes therewith.

SUMMARY OF THE INVENTION

In accordance with the present invention, a washing machine can achieve highly satisfactory washing of fabric articles when equipped with an improved pulsator.

The improved pulsator of the present invention achieves such results by establishing localized, highly agitated turbulent flow near the center portion due to a projection being shaped so as to define a flat region eccentrically offset relative to the rotational center of the pulsator. Moreover, in accordance with the present invention, the pulsator dramatically improves and enhances vortex flow-inducing characteristics of conventional radially extending vanes due to the localized areas of highly agitated turbulent flow. The projection extends above the middle of the tub so as to establish the highly agitated localized flow briefly described above. Thus, in accordance with the present invention, flow patterns of sufficient force are induced to clean the fabric articles due to hydraulic action of the washing liquid.

Additionally, since the present invention does not solely depend upon mechanical engagement of the pulsator with the fabric articles to achieve satisfactory washing, the projection of the present invention can be provided with a smoothly rounded external surface. Thus, although the projection will contact and rub against the fabric articles during the washing cycles to further enhance the washing thereof, such rubbing action will not be unduly abrasive due to the smoothly rounded external surfaces. Accordingly, mechanical enhancement of the washing function can be utilized without fear of damaging the fabric articles.

Furthermore, the action of the present invention, due to its eccentrically offset projection, provides compressive washing of the fabric articles as the projection moves in an eccentic motion about the rotational axis.

These and other advantages of the present invention will become more clear to the reader after careful consideration is given to the detailed description of the preferred exemplary embodiment thereof which follows.

BRIEF DESCRIPTION OF THE ACCOMPANYING DRAWINGS

Reference will be hereinafter made to the accompanying drawings forming a part hereof, wherein like reference numerals throughout the various Figures denote like structural elements, and wherein.

DETAILED DESCRIPTION OF THE PREFERRED EXEMPLARY EMBODIMENT

A particularly preferred exemplary embodiment of the present invention will now be explained and the reader's attention is specifically directed to the accompanying drawings for the discussion which follows.

Figure 1:
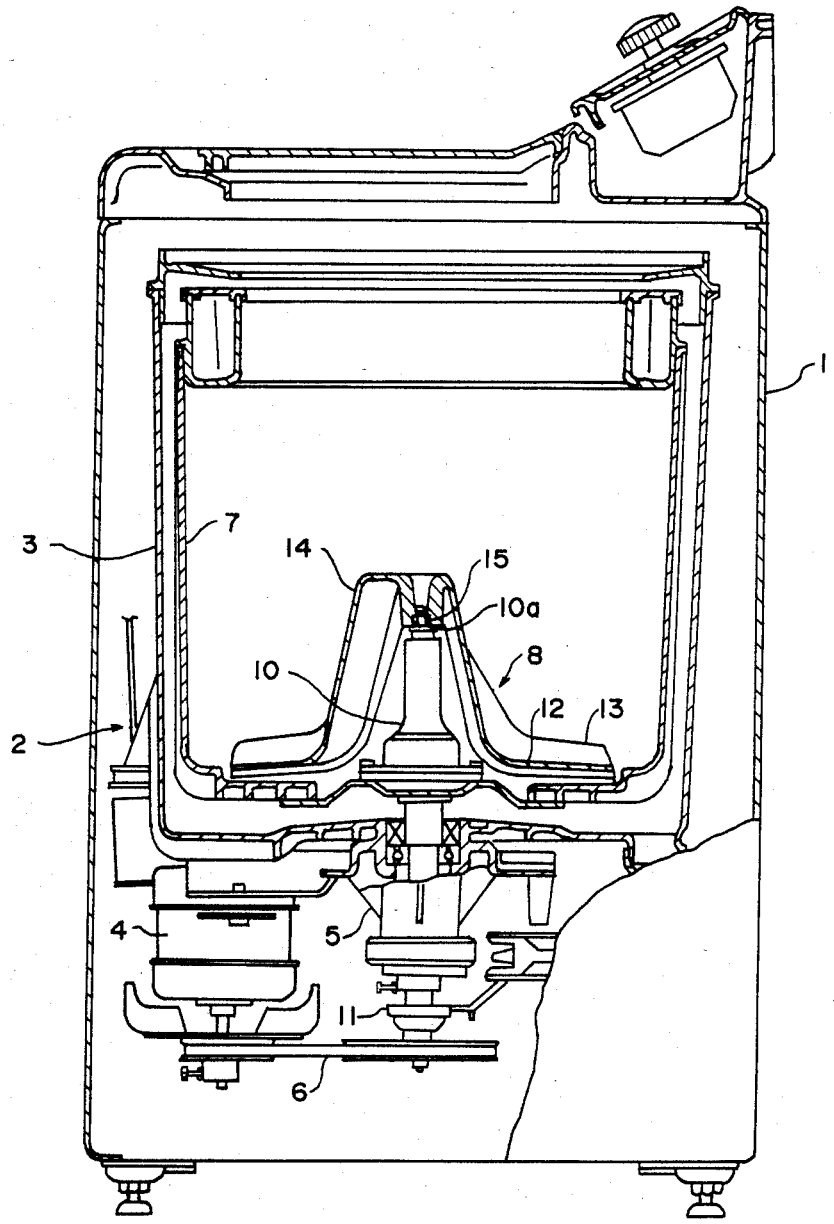
FIG. 1 is a side view, partially in section, of a washing machine according to the present invention.

As can be seen in FIG. 1, casing 1 includes a water-receiving tub 3 suspended by elastic suspension member 2 which functions so as to absorb erratic movement of the tub 3. Pulsator 8 is centrally mounted therein, the purpose and function of which will be described in more detail below. Water receiving tub 3 is itself fixedly mounted with respect to rotary tub 7 which, in the embodiment of the washing machine shown, serves the dual purpose of a washing and drying tub. The reader should, of course, appreciate that the present invention can also be suitably utilized when tub 7 is solely a washing tub.

The rotary tub 7 is fixedly connected to rotary shaft 9 of a mechanism section 5 which transmits rotary movement in a predetermined manner thereto while pulsator 8 is connected to mechanism section 5 by a separate pulsator shaft (not shown) operatively interconnected with a reduction gear system 10 provided in the interior lower region of rotary tub 7.

The mechanism section 5 includes a clutch mechanism 11 for selectively transmitting the rotary motion provided by drive motor 4 to the pulsator shaft and to the rotary shaft 9 in such a manner that during washing cycles, the pulsator 8 is independently rotated while during drying cycles both the rotary tub 7 and the pulsator 8 are rotated as a unit. Moreover, pulsator 8 is permitted to rotate in forward and reverse directions in successively repeated cycles. For example, pulsator 8 can rotate through three revolutions in the forward direction followed by rotation through three revolutions in the reverse direction. This cycle of operation is successively repeated so as to induce agitation of the wash liquid in the tub 7.

Figure 2:
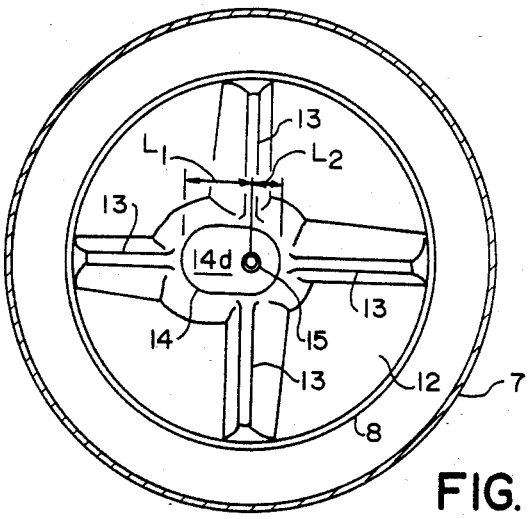
FIG. 2 is a plan view of the pulsator of the present invention.

The detailed construction of the pulsator 8 of the present invention will now be described and the reader's attention is specifically directed to accompanying FIGS. 1 and 2.

Skirt 12 substantially extends over the entire interior bottom region of rotary tub 7. Vanes 13 are radially disposed from the central portion of skirt 12 while projection 14 vertically extends higher than the vanes 13 at the top of this projection 14. Shaft coupling 15 is provided and is coincident with the rotational center of skirt 12. Output shaft 10*a* (see FIG. 1) of reduction gear mechanism 10 is operatively coupled to shaft coupling 15. As is evident from FIG. 2, the upper end of projection 14 defines a flat surface 14*d* eccentrically offset relative to the rotational axis of skirt 12 (e.g. shaft coupling 15) and defines, in plan, an oval shape, for example. In this case the longest distance L1 of projection 14 as measured from the center of rotation of skirt 12 to the outermost edge 14*b* of surface 14*d* is dimensioned so as to be within the range of about 1.5–2.5 times the shortest distance L2 as measured from the center of rotation of skirt 12 to the edge 14*b* opposite the outermost edge 14*b* (see FIG. 2). As used herein and in the accompanying claims, the term "eccentricity" shall mean the ratio of $L_1/L_2$.

The operation of the above construction will now be explained. Considering first of all the wash cycle, when the pulsator 8 is rotated, the wash liquid in the rotary tub 7, taken as a whole, is formed into a vortex by the vanes 13 in a manner which is known in and of itself.

However, this known vortex flow arrangement is to some extent induced to flow in the centrifugal direction (e.g. towards the sidewalls of tub 7) by virtue of side surfaces 14*a* of projection 14 which extend higher than vanes 13 with the result that a turbulent flow is formed, and the agitation effect on the washing water is thereby increased. That is, the vector flow of the vortex flow arrangement induced by the vanes is disturbed by the centrifugal vector flow induced by surfaces 14*a* to establish localized turbulent flow patterns or eddy currents.

Fabric articles A (see FIG. 3) that are held in the rotary tub 7 with the washing liquid are therefore induced to assume complex motion by the localized turbulent interruption of the vortex flow by projection 14. Thus, fabric articles A are moved about and hydraulically manipulated in a complex manner due to the complex flow established by the pulsator 8 to subject them to hydraulic wringing and scrubbing actions and to thus increase the cleansing effect.

Figure 3:
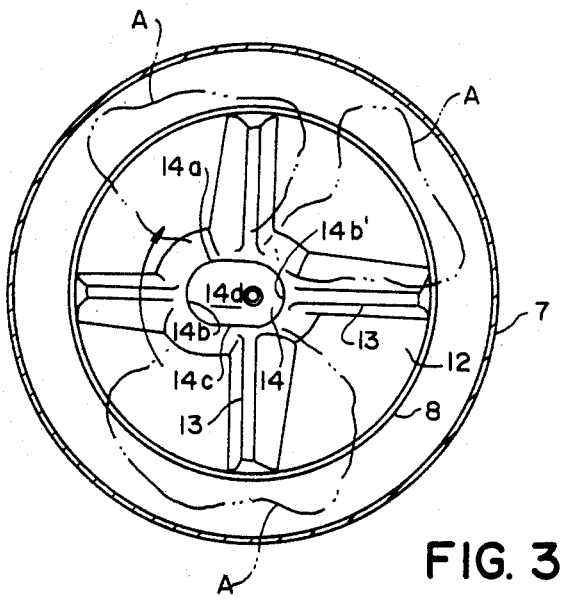
FIG. 3 is a diagrammatic plan view showing the rotary tub portion and action of the pulsator therein.

In particular, due to the rotation of pulsator 8, projection 14 rotates around the inside of rotary tub 7 as indicated by the arrow in FIG. 3. The side surface 14*a* of projection 14 as a whole apply an external force during rotation thereof so that the fabric articles A are centrifugally swished. That is, a swishing washing action is produced. Surfaces 14*a* also function to mechanically rub the fabric articles A so that rubbing washing action is produced. Moreover, edge 14*b* will mechanically squeeze the articles A as it continues to skirt 12 so as to produce squeezing washing action.

However, upon continued rotation of projection 14, fabric articles A are then laterally compelled towards the projection 14 due to the eddy currents established by side surface 14*c* as the eccentrically offset portion travels through the wash liquid. As a result, fabric articles A are initially hydraulically moved laterally away from projection 14 due to side surface 14*a;* are then mechanically rubbed by edge surface 14*b;* and then are compelled towards projection 14. This back and forth cycle of fabric articles A due to the locailized eddy current established by rotation of projection 14 coupled with the mechanical rubbing action thereof greatly enhances the washing action of pulsator 8. Thus, the agitation effect on the fabric articles A is increased. In general therefore, in addition to being able to achieve a substantial increase in the cleansing effect on the fabric articles A, uneven washing can be eliminated in accordance with the present invention.

When the pulsator changes over from a forward rotational direction to a reverse rotational direction and vice versa, the water flow also changes over, with some delay. During such transition or dwell period, the articles A are temporarily virtually stationary. The projection 14 of pulsator 8, which having its rotational direction previously changed over, is thus in process of rotation while the articles are temporarily stationary. As a result, when the fabric articles begin to move in a reversed direction, pulsator 8 applies a more reliable and powerful drawing and squeezing action to such fabric articles A. This effect therefore promotes the swishing and squeezing washing action described above so that a high cleansing effect can generally be achieved.

Figure 4:
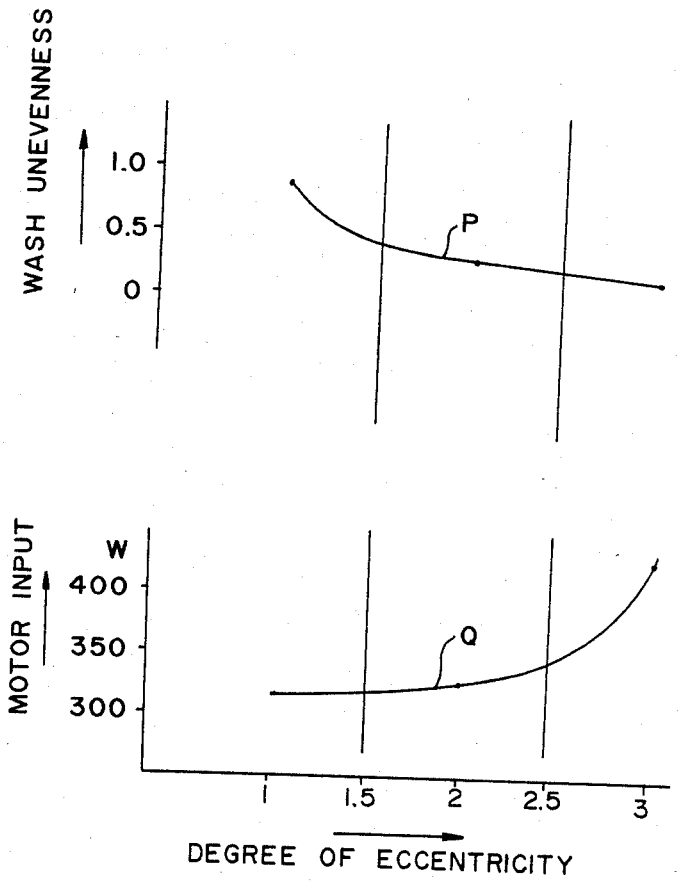
FIG. 4 is characteristic diagram showing wash unevenness and motor input as a function of eccentricity.

In particular, due to the rotation of the pulsator 8, the projection 14 rotates around the axis of rotation for rotary tub 7 as shown by the arrow in FIG. 4. During such rotational motion, projection 14 encounters a portion of the fabric articles A and, due to the hydraulic action of the vortex flow tending to draw the articles in towards the central portion of the rotary tub, the articles will be pressed against the the projection 14 due to the external compressive forces established by the vortex flow. Such compressive forces induce wash liquid to flow through the fabric articles so as to aid in the removal of soil, dirt or the like which may be trapped in the interstices thereof.

Moreover, as the projection 14 moves along its rotational path, it rubs against portions of the fabric articles to further mechanically enhance the cleansing effect thereof. External hydraulic forces are also applied against the fabric articles due to the localized areas of highly turbulent flow that are induced during eccentric movement of projection 14 through the wash liquid. Such external hydraulic forces serving to randomly hydraulically manipulate the fabric articles and thus promote the cleansing effect.

Moreover, in the period of transition when the pulsator 8 changes its rotation between the forward and reverse directions, the fabric articles A are temporarily substantially stationary whereas the pulsator 8 is already moving in the reverse direction due to the fact that there is a dwell interval between direction reversal of the pulsator 8 and the responsive direction reversal of the vortex flow. Thus, the projection 14 of the pulsator 8 functions to also apply a more positive and powerful drawing and squeezing action to the fabric articles A while in this stationary state than it does while the articles A are moving. This action therefore effectively promotes the compressive and rubbing forces described earlier the combination of which achieves a high cleansing effect.

Also, in accordance with this invention, since the reversal cycle of the pulsator 8 is preselected at about three rotations, the forces tending to compress, randomly manipulate and rub the articles, promotes efficient washing operations which can be adequately and uniformly performed on all of the fabric articles A. However, it should be noted that a reversal of at least one revolution can be just as adequately effective.

Conventional washing machines typically include a cylindrical projection centrally and symmetrically attached to the pulsator. However, since such a conventional arrangement only forms a vortex flow in the liquid, the articles being washed are only induced to move towards the projection by virtue of such vortex flow. As a result, the fabric articles sometimes tend to become wrapped around the conventional symmetric projection so that inadequate interchange of the articles as a whole in the wash liquid occurs and thus uneven or poor washing action is obtained.

However, in accordance with the present invention, since the projection 14 defines a flat surface **14*d* eccentrically disposed relative to the center of rotation of skirt 12, vector flow from the center of skirt 12 in the centrifugal direction can be imparted to the wash liquid to induce responsive outward "swishing" movement of the fabric articles. Additionally, the fabric articles are repetitively moved in a back and forth manner in rotary tub 7 by virtue of the rotational reversal of pulsator 8** therein. The cleansing effect can consequently be increased and interchange of the fabric articles with the wash liquid can be performed in a satisfactory manner to eliminate uneven washing thereof.

If the eccentricity of projection 14 is increased (i.e. if ratio $L_1/L_2$ of the longest distance $L_1$ from the center of rotation of skirt 12 in the longitudinal direction of projection 14 to the shortest distance $L_2$ is increased) an increase in the degree of agitation will result, but the resistance on the pulsator 8 received from the wash liquid also increases. Thus, the net effect is that the input of motor 4 will increase. These relationships are shown more specifically in FIG. 4 wherein "wash unevenness" and "motor input" form the abscissa axes while "eccentricity ($L_1/L_2$)" forms the ordinate axis of the curves depicted therein. Curve P in FIG. 4 shows the wash unevenness characteristic while curve Q shows the motor input characteristic. As is evident from an inspection of curves P and Q in FIG. 4, when the ratio $L_1/L_2$ is 1.5–2.5, wash unevenness and motor input are both relatively small. Accordingly, in an embodiment of the present invention wherein the longest distance $L_1$ from the center of rotation of skirt 12 in the longitudinal direction of projection 14 is about 1.5–2.5 times the shortest distance $L_2$, the input of motor 4 is maintained within acceptable limits and wash unevenness is reduced.

In the above described embodiment, the projection 14 defines a surface **14*d* of oval shape as viewed in plan, but a roughly elliptical or roughly rectangular form is also acceptable and will produce similar beneficial results. More important than the shape of surface 14*d*** is that it should define a substantially flat, horizontal surface.

As is now clear from the above description, in a washing machine wherein the pulsator provided with the tank comprises a skirt, vanes projecting from the skirt, a projection projecting higher than the vanes at roughly the center location of the skirt, wherein washing is performed through forwards and reverse rotation of such a pulsator, the present invention is specifically characterized in that the projection is provided and shaped so that it defines a substantially flat surface in plan view eccentrically disposed relative to the center of rotation of the skirt. The flow of wash liquid can thereby be made more complex than vortex flow alone and the cleansing effect due to such complex flow can be increased. In particular, swishing-type washing, rubbing-type washing, and squeezing-type wash can be effected upon the fabric articles being washed by virtue of the external mechanical and hydraulic forces produced by the projection. Such agitation effects can be substantially increased and interchange of the fabric articles in the washing tub can be satisfactorily performed. The net effect of the present invention is that the cleansing action can be appreciably increased and uneven washing of the fabric articles can be substantially eliminated.

The illustrated embodiment should not be considered to be restrictive, but rather, those in this art may recognize that various changes may be made thereto without departing from the scope of the invention, as defined in the appended claims, which claims shall be accorded the broadest interpretation thereof to encompass all equivalent structures and/or assemblies.

What is claimed is:

1. A washing machine comprising:

tub means defining an interior area for holding liquid in upper and lower regions therein;

a pulsator rotatably mounted relative to said tub means and disposed in said interior area thereof, said pulsator including a skirt area having a raised central portion extending to a predetermined upper limit and defining a central axis of rotation, said upper limit together with said skirt area being disposed within said lower region of liquid in said tub means, plural vane means each having an upper end terminating at said upper limit and radially extending from said upper limit to the periphery of said skirt to establish vortex flow within said liquid in said upper and lower regions, and means fixed to said skirt for enhancing the agitation of said liquid in said tub means, said agitation enhancing means having a projection portion vertically extending higher than said upper limit of said raised central portion so as to vertically extend above said upper end of said raised central portion and thus above said plural vane means, said projection portion defining an upper substantially planar surface having an opposing pair of smoothly rounded ends and an opposing pair of parallel sides, said ends and sides together defining a perimetrical edge of said upper substantially planar suface as viewed in plan, said upper surface by virtue of said vertical extension above said upper limit being disposed within said upper region of liquid in said tub means, said projection portion also defining side walls interconnecting said perimetrical edge of said upper surface and said upper end of each said plural vane means, said upper surface being eccentrically oriented relative to said central rotational axis to establish a first dimension $L_1$ from said central rotational axis to one of said pair of rounded ends of said upper surface and a second dimension $L_2$ from said central rotational axis to the other of said rounded ends of said upper surface, wherein $L_1$ is greater than $L_2$ so as to establish an eccentricity ratio $L_1/L_2$; and drive means connected to said pulsator for rotating said pulsator in predetermined forward and reverse cycles about said central rotational axis, said agitation enhancing means, in response to eccentric rotation thereof about said central rotational axis upon rotation of said pulsator by said drive means, for (i) establishing localized areas of highly turbulent flow within said vortex flow so that fabric articles will be randomly turbulently manipulated when encountering said turbulent flow and (ii) creating a force generally opposite said direction of vortex flow in said upper region of said liquid in said tub means when said agitator enhancing means comes into contact with said fabric articles to responsively compress said fabric articles so as to facilitate the cleansing thereof.

2. A washing machine according to claim 1, wherein said tub means comprises an outer stationary tub and an inner tub.

3. A washing machine according to claim 2, wherein said drive means includes means for reversally rotating said pulsator in periodic repeatable cycles.

4. A washing machine according to claim 1, wherein said pulsator includes four vanes projecting from said skirt at equally spaced locations.

5. A washing machine as in claim 1 wherein said side walls of said agitation enhancing means includes means defining smoothly rounded external surfaces to prevent excessive mechanical abrasion of said fabric articles when said agitation enhancing means comes into contact therewith.

6. A washing machine as in claim 1 wherein said smoothly rounded ends of said agitation enhancing means induces centrifugal flow of said liquid, said induced centrifugal flow interacting with said vortex flow to establish said localized areas of turbulent flow.

7. A washing machine as in claim 1 wherein L1 is about 1.5 to about 2.5 times greater than L2.

* * * * *